US005424768A

United States Patent [19]

Dudek et al.

[11] Patent Number: 5,424,768

[45] Date of Patent: Jun. 13, 1995

[54] ZERO-VOLUME MAINTENANCE CAP FOR AN INK JET PRINTHEAD

[75] Inventors: Lesley P. Dudek; Dale R. Ims, both of Webster; Michael C. Ferringer, Ontario, all of N.Y.

[73] Assignee: Xerox Corporation, Stamford, Conn.

[21] Appl. No.: 78,340

[22] Filed: Jun. 21, 1993

[51] Int. Cl.[6] ..... B41J 2/165

[52] U.S. Cl. ..... 347/29

[58] Field of Search ..... 347/22, 29, 30, 33

[56] References Cited

U.S. PATENT DOCUMENTS

| | | | |
|---|---|---|---|
| 4,306,245 | 12/1981 | Kasugayama et al. | 347/74 |
| 4,340,897 | 7/1982 | Miller | 347/33 |
| 4,369,456 | 1/1983 | Cruz-Uribe et al. | 347/33 |
| 4,401,990 | 8/1983 | Aiba et al. | 347/33 |
| 4,567,494 | 1/1986 | Taylor | 347/30 |
| 4,571,601 | 2/1986 | Teshima | 347/33 |
| 4,853,717 | 8/1989 | Harmon et al. | 347/29 |
| 5,051,758 | 9/1991 | Markham | 347/33 X |
| 5,081,472 | 1/1992 | Fisher | 347/33 |
| 5,103,244 | 4/1992 | Gast et al. | 347/33 |
| 5,115,250 | 5/1992 | Harmon et al. | 347/33 |
| 5,151,715 | 9/1992 | Ward et al. | 347/33 |

FOREIGN PATENT DOCUMENTS

| | | | |
|---|---|---|---|
| 0314513 | 5/1989 | European Pat. Off. | 347/33 |
| 4-65248 | 3/1992 | Japan | 347/33 |
| 4-187444 | 7/1992 | Japan | 347/29 |
| 4-247954 | 9/1992 | Japan | 347/29 |

*Primary Examiner*—Benjamin R. Fuller
*Assistant Examiner*—John E. Barlow, Jr.
*Attorney, Agent, or Firm*—Tallam I. Nguti

[57] ABSTRACT

A capping device for an ink-jet printhead having a nozzle opening defined in a surface thereof. A deformable member is urged into engagement with the surface at a predetermined pressure, causing a portion of the deformable member to be deformed into the nozzle opening to seal the nozzle opening of the printhead.

18 Claims, 4 Drawing Sheets

ZERO-VOLUME MAINTENANCE CAP FOR AN INK JET PRINTHEAD

The present invention relates to ink-jet printing, and is more particularly concerned with a cap for maintaining the viability of an ink-jet printhead in an idling mode, without subsequent need for purging or priming.

In existing thermal ink jet printing, the printhead typically comprises one or more ink ejectors, such as disclosed in U.S. Pat. No. 4,463,359, each ejector including a channel communicating with an ink supply chamber, or manifold, at one end and having an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. As the bubble grows, the ink rapidly bulges from the nozzle and is momentarily contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a print sheet, such as a piece of paper. Because the droplet of ink is emitted only when the resistor is actuated, this type of thermal ink-jet printing is known as "drop-on-demand" printing. Other types of ink-jet printing, such as continuous-stream or acoustic, are also known.

In a single-color ink jet printing apparatus, the printhead typically comprises a linear array of ejectors, and the printhead is moved relative to the surface of the print sheet, either by moving the print sheet relative to a stationary printhead, or vice-versa, or both. In some types of apparatus, a relatively small printhead moves across a print sheet numerous times in swaths, much like a typewriter; alternatively, a printhead which consists of an array of ejectors and extends the full width of the print sheet may be passed once down the print sheet to give full-page images, in what is known as a "full-width array" (FWA) printer. When the printhead and the print sheet are moved relative to each other, imagewise digital data is used to selectively activate the thermal energy generators in the printhead over time so that the desired image will be created on the print sheet.

A well-known practical problem in the operation of ink-jet printers is the drying of ink in the nozzles in periods in which the system is inactive, or "idling." This drying of ink in the nozzles results from the loss of solvent, which is in most cases water, to the printing environment. The dyes, additives, and other vehicles in the ink may remain in the channels or nozzles, but sufficient evaporation of the solvent is frequently observed to cause clogging of printhead nozzles during even short periods of non-use. If a particular ejector is not used for an appreciable length of time, even while the system is printing a document, a "viscous plug" of partially-dried ink will, in effect, cause a clot in the particular ejector, causing the ejector to fail at least temporarily, at least until the reheating of the particular ejector softens the viscous plug. A viscous plug often creates a partial blockage of an ejector, causing an ink droplet ejected therefrom to be misdirected. In ink-jet printers, a failure of even one ejector will have conspicuous results on a print, because the plugged ejector will leave a blank stripe across a printed area where the ink from the ejector should have been placed. Thus, the failure of even a very few ejectors in a system will render the entire system unsatisfactory to a demanding user. Therefore proper maintenance of the ejectors is of crucial importance to a practical ink-jet printer.

Prior-art capping schemes have been developed which either enclose the area of the printhead in a limited volume of air, or in an environment humidified by contact with a reservoir of solvent, which may be simply a quantity of water allowed to evaporate from a wick. Upon capping with such a device, these prior art schemes often require substantial time periods to equalize the relative humidity both inside and outside the nozzles to an extent sufficient to halt evaporation. Also, pinhole openings in such prior art caps have been shown to allow a total loss of humidity into the system, which is difficult to compensate for by passive humidification.

U.S. Pat. No. 4,340,897 discloses a cleaning device for an ink-jet writing head wherein the nozzles of the writing head are urged into contact with a manifold having a set of brushes thereon. Vacuum is applied through the brushes to remove excess ink from the nozzles.

U.S. Pat. No. 4,369,456 discloses a cleaning device for an ink-jet printer having a movable absorbent cleaning belt extending between two reels, which passes over the front faces of the ink-jet writing heads. The belt has defined therein a set of openings so that the writing head may be operated. Between jobs, the belt is advanced and embossed portions of the belt clean ink and impurities from the nozzle as the belt is indexed.

U.S. Pat. No. 4,401,990 discloses an ink-jet printer having a movable carriage traveling across the printing region. A nozzle for emitting ink droplets in a slidable member is disposed on the carriage. The slidable member includes a cleaning pad for cleaning the front surface of the nozzle. When the carriage is positioned at the end of the printing region, the slidable member is slid on the carriage so that the cleaning pad contacts the front surface of the nozzle.

U.S. Pat. No. 4,567,494 discloses an ink-jet printer, the nozzles of which are primed and cleaned after each print line by engaging the nozzles with an elastomeric suction cup. The suction cup includes an inner cup of foam which wipes of any residual ink droplets. The cup is connected to a vacuum pump for drawing ink out of the nozzles.

U.S. Pat. No. 4,853,717 discloses a maintenance station for an ink-jet printer comprising a pump for priming the printhead, and wiping means for cleaning the printhead. The wiper is stationary relative to the apparatus, so that when the printhead on a carriage passes across the wiper in the carriage motion, the wiper is moved across the front face of the printhead.

U.S. Pat. No. 5,051,758 discloses a rotary cleaning device for an ink-jet printer including a cylindrical supporting member having a flexible wiping blade which is rotated in the motion path of the printhead nozzles in a carriage-type ink-jet printer. At the end of a carriage motion, the rotatable member causes a helically-disposed wiper blade to slide against the nozzles of the printhead.

U.S. Pat. No. 5,081,472 discloses a cleaning device for a carriage-type ink-jet printer. The cleaning device comprises a rotatable drum having at least one slot in which an absorbent material covered with a mesh material is inserted. When the printhead is located by the cleaning station, the drum is rotated and the covered absorbent material wipes the nozzle face.

U.S. Pat. No. 5,103,244 discloses an ink-jet printer cleaning system including a multi-blade wiper which is indexed automatically to permit each printhead in the apparatus to be wiped by a selected blade. This system is useful for color printing systems in which several printheads, each for a different color, are movable on a single carriage across the printing area. When the carriage contacts the end of the carriage path, the carriage engages a lever which causes indexing of the multi-blade wiper.

U.S. Pat. No. 5,115,250 discloses a rotary wiper for use in a carriage-type ink-jet printer. The wiper includes a plurality of blades which successively wipe contaminants from the orifice played to the printhead during rotation of the wiper. The wiper is rotated by a motor or by a rack-and-pinion arrangement, in which the rack is disposed on the printhead carriage and actuates the wiper as the printhead moves into the surface station at the end of the printing area.

U.S. Pat. No. 5,151,715 discloses a printhead wiper for carriage-type inkjet printers. The wiper is molded from an elastomer which stays in a stationary position while the printhead on the carriage moves past it. As the printhead passes over the wiper, the wiper wipes the front face of the printhead.

According to the present invention, there is provided a capping device for an ink-jet printhead having a nozzle opening defined in a front face. A deformable member is urged into engagement with the surface at a predetermined pressure, causing a portion of the deformable member to be deformed into the nozzle opening to seal the nozzle opening of the printhead.

Figure 6:
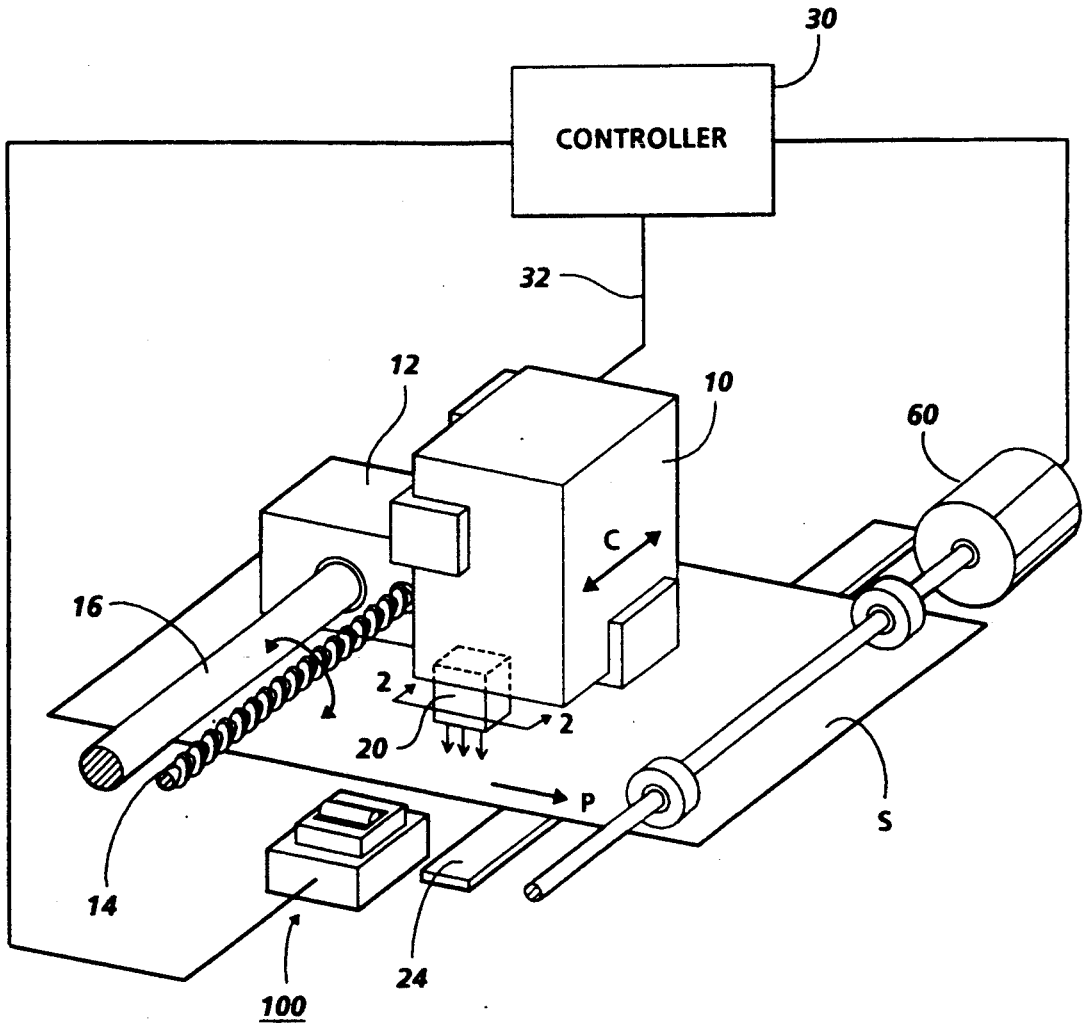
FIG. 6 is a perspective view showing the basic elements of a reciprocating-carriage-type thermal ink-jet printer.

FIG. 6 shows the basic elements of a reciprocating-carriage-type thermal ink-jet printer for creating color or monochrome images on a sheet S. An ink cartridge 10, having a plurality of ink supplies therein, is preferably removably mounted on a carriage 12. This carriage 12 is adapted to move in a back-and-forth manner in direction C across sheet S, which is moving in process direction P. The sheet S is caused to move in direction P by means of a stepper motor or other indexing motor 60, which is preferably adapted to cause the motion of sheet S in direction P in a stepwise fashion, holding the sheet S in a stationary position while the cartridge 10 moves across the sheet in direction C, and then indexing the sheet S in processing direction P between swaths of printing caused by the action of cartridge 10 on carriage 12.

Carriage 12 is provided with one of various possible means for moving the cartridge 10 back and forth across sheet S. As shown in FIG. 6, there is provided a rotatable lead screw 14 having threads thereon which interact with a structure on the carriage 12 so that, when lead screw 14 is caused to rotate by a motor (not shown), the interaction of the lead screw threads with the structure on carriage 12 will cause the carriage 12 and the cartridge 10 mounted thereon to move in direction C across the sheet S. Preferably, in most embodiments of an ink-jet printer for use with the present invention, the behavior of the lead screw 14 should allow substantially even back-and-forth motion of the cartridge 10 so that the printing operation can be carried out in both directions. This may be accomplished, for example, by operatively attaching lead screw 14 to a bidirectional motor, or providing oppositely-wound sets of lead screw threads on lead screw 14 so that, once carriage 12 is moved to one side of the sheet S, the structure on carriage 12 will reengage with the oppositewound threads on lead screw 14 to be moved in the opposite direction while the lead screw 14 is rotated in the same rotational direction. Further mechanical stability is provided for the motion of carriage 12 by, for example, a stabilizing rod 16 which passes through an opening in the carriage 12.

At the bottom of cartridge 10, as shown in FIG. 6, is a printhead 20, which is shown directed downward toward the sheet S. Printhead 20 comprises one or more linear arrays of thermal ink-jet ejectors, each ejector being operatively connected to a particular ink supply, in a manner which will be described in detail below, depending on the specific embodiment of the present invention. Generally, the linear array of ejectors in printhead 20 extends in a direction parallel to process direction P, so that, when the cartridge 10 is caused to move in carriage direction C, the linear array will "sweep" across the sheet S for an appreciable length, thus creating a print swath. While the carriage is moving across the sheet S, the various ejectors in the linear array are operated to emit controlled quantities of ink of preselected colors in an imagewise fashion, thus creating the desired image on the sheet. Typical resolution of the ink-jet ejectors in printhead 20 may be from 200 spots per inch to 800 spots per inch.

Also provided "downstream" of the printhead 20 along process direction P is drying means which are generally shown in FIG. 6 as a heating plate 24. The purpose of the drying means is to provide energy to ink which has just been placed on the sheet S, so that the ink will dry more quickly. Although a heating plate 24 s shown in FIG. 1, the drying means may include any number of devices for conveying heat or other energy to the ink placed on the sheet S. One particular drying means, for example, is a device for conveying microwave energy to the ink on the sheet, thereby dehydrating the sheet while limiting the extent of heat spread throughout the system, which may have an adverse effect on the operation of the printer as a whole. Other techniques for drying the ink in an efficient manner may also be contemplated such as providing a light flash, radiant or convective heat, or creating induction heat within a conductive member adjacent the sheet.

Operatively associated with the printhead 20 is a data input device, or controller, which is generally shown by a schematic box 30 connected by a bus such as 32 to the printhead 20. The purpose of the controller 30 is to coordinate the "firing" of the various ejectors in the printhead 20 with the motion of cartridge 10 in carriage direction C, and with the process direction P of sheet S, so that a desired image in accordance with the digital data is rendered in ink on the sheet S. Image data in digital form is entered into controller 30, and controller 30 coordinates the position of the printhead 20 relative to a sheet S, to activate the various ejectors as needed, in a manner generally familiar to one skilled in the art of ink-jet printing. Controller 30 will also be operatively associated with the various motors such as 60, controlling the position of sheet S through process direction P, and also the motion of the carriage 12, through means not shown.

Figure 1:
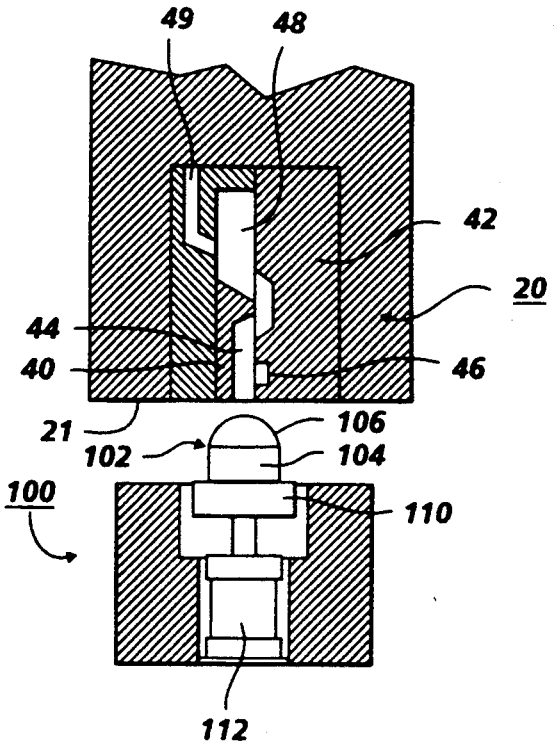
FIG. 1 is a sectional elevational view through a printhead of an ink-jet printing apparatus, and also of a maintenance station incorporating the present invention as it interacts with the printhead.

FIG. 1 shows in its upper portion a simplified sectional, elevational view of a single ejector 22 of several in the linear array of ink-jet ejectors in printhead 20, as part of cartridge 10. (The linear array, in this view, extends into the page.) The printhead, according to the illustrated "side-shooter" design, comprises two key parts, a "channel plate" 40 and a "heater plate" 42. Preferably, each of these plates 40 and 42 is made of a single piece of silicon for the entire printhead 20. The channel plate 40 and the heater plate 42 are abutted together to form the linear array of ejectors between them. The channel plate 40 has defined therein on the face thereof facing the heater plate 42, a plurality of channels, one of which is shown as 44. Thus, there is defined in a front face 21 of printhead 20 a plurality of nozzle openings, which are the openings of the channels 44.

Adjacent each channel 44 in the channel plate 40 is a heating element 46. Each heating element 46 is operatively connected by circuit means (not shown) to a controller such as 30, which provides electrical power to the heating element when it is desired to "fire" the particular ejector. Each heating element 46 includes an effective surface which becomes hot when electricity is applied to heating element 46, and this effective surface is exposed to the void formed by the adjacent channel 44. In a typical preferred design, the heating element 46 is itself disposed in a slight pit adjacent channel 44, as shown, in order to improve the general performance of the printhead. Each channel 44 is in communication with an ink supply manifold 48. Preferably, a plurality of channels 44 in a contiguous subset are operatively connected to one ink supply manifold 48, which functions as a common ink supply for all of the ejectors connected thereto. Both the channels 44 and the ink supply manifolds 48 are created as voids within a single silicon channel plate 40 by known etching techniques. The ink supply manifold 48 is in turn accessed to a larger supply of ink through a tube such as 49, or any other means which will be apparent to one skilled in the art. In the embodiment shown, the tube 49 is formed as a void in a further member adjacent to the channel plate 40; generally speaking, however, the precision of the tube 49 into ink supply manifold 48 need not be as great as in the formation of the channels 44, and therefore tube 49 may be defined in an inexpensive material such as plastic.

Briefly, a side-shooter printhead, as illustrated in FIG. 1, works as follows. Ink of a preselected type is introduced through tube 49 into manifold 48 and is then conducted into a plurality of channels such as 44. When in the course of printing a document, a pixel corresponding to a particular channel 44 is to be printed upon, a signal is sent by the control means to the corresponding heating element 46, and the energy of the signal causes heat to be generated in the channel 44. The heat causes the vaporization of ink in the channel 44, and liquid ink in the channel 44 is pushed out in the form of a droplet toward the sheet. Once a quantity of liquid ink is ejected from the channel 44, the channel 44 is replenished from ink supply manifold 48.

Returning to FIG. 6, there can be seen, disposed along the path of the carriage 12 in carriage direction C, a maintenance station 100 disposed off to one side of the path of the sheet S through process direction P. This maintenance station 100 is spaced from the path of the sheet S to serve as a "rest" location for the carriage 12 and cartridge 10 between printing jobs, or when the apparatus is not in use or otherwise idling. At the end of a printing job, the controller 30 causes the lead screw 14 to be rotated to such an extent that the printhead 20 on cartridge 10 is aligned with maintenance station 100.

Figure 2:
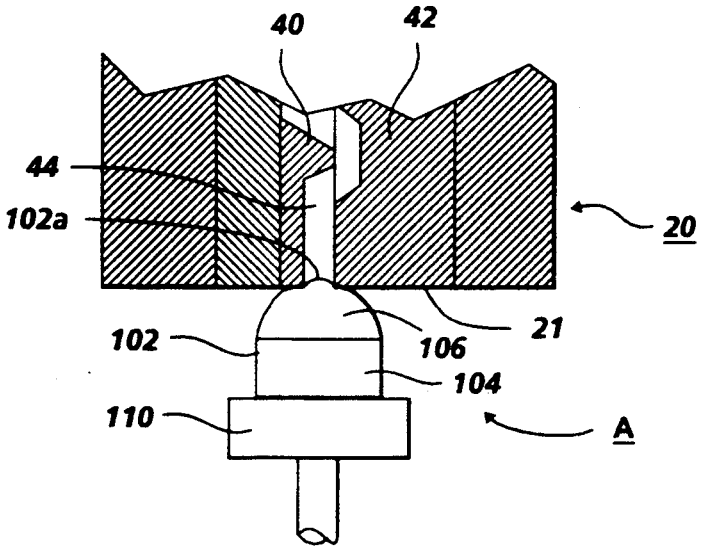
FIG. 2 is an enlarged, fragmentary, elevational sectional view showing the interaction of a deformable finger according to the present invention interacting with a channel of a thermal ink-jet ejector.

The lower portion of FIG. 1 shows how the maintenance station generally indicated as 100 interacts with the printhead 20 when the cartridge 10 and carriage 12 is in the maintenance position. Disposed on maintenance station 100 is a deformable finger 102 which is so sized and shaped as to extend the length of the linear array of ejectors in printhead 20. Once again, as shown in FIG. 2, the finger 102 extends into the page to correspond to the linear array which extends into the page. The finger 102 preferably comprises an inner portion 104 being made of red RTV silicone, and a contact portion 106 being preferably made of a clear, flowable silicone. The outer surface of the finger 102 is preferably of low energy, and preferably hydrophobic; that is, liquid deposited on the outer surface of finger 102 should be repelled.

The finger 102 is, in this embodiment, disposed on a platform 110, which in turn is mounted on an urging device 112. Urging device 112 may be of any design known in the art for causing the platform 110 to be urged against the front face of the printhead 20, so that the finger 102 will be pressed into all of the openings of channels 44 in printhead 20. The urging device 112 shown in FIG. 1 is a generalized solenoid device for selectably urging platform 110 toward the printhead 20, but various devices for performing this function will be apparent to one skilled in the art, such as devices comprising a cam and follower, a lever or linkage, a clutch for selectably engaging a rotating motor, or even a piston responsive to the pressure of a liquid, according to a desired system design.

A preferred "diameter" for the width of the finger 102 is from 1 to 2.5 millimeters. The finger should preferably be of a sufficient hardness so that, under a typical preferred pressure of 500 grams per square centimeter exerted by the electromagnetic urging device 112, the width of the contacting area is not much larger than the width of the channels 44. As a typical diameter of a channel 44 in a 300 spot-per-inch printhead is about 50 micrometers, a preferably width of the contact area across the diameter of the finger 102 is about 0.5 millimeters.

Figure 3:
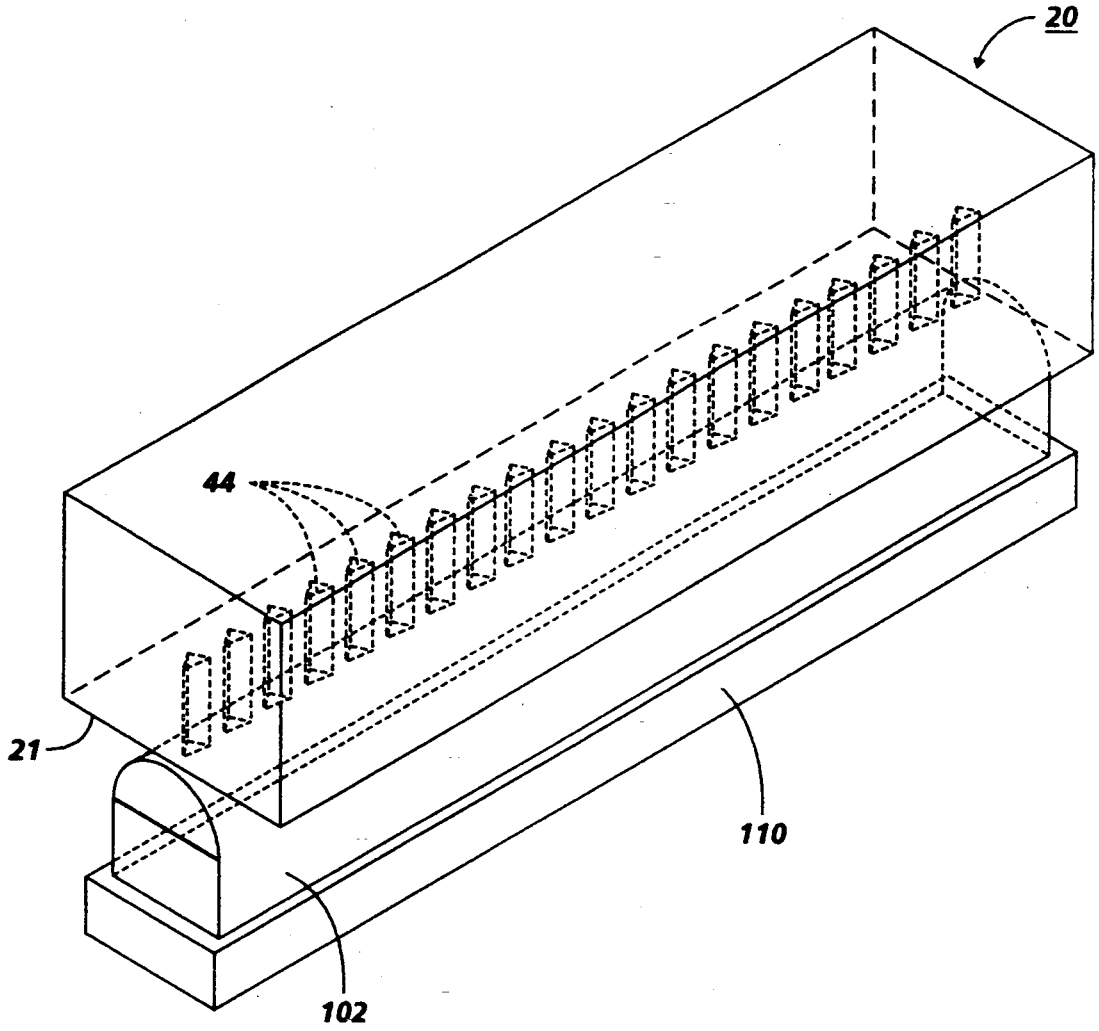
FIG. 3 is a simplified perspective view showing a finger according to the present invention substantially lengthwise and interacting with a linear array of nozzle openings in a printhead of a thermal ink-jet printing apparatus.

FIG. 2 is a detailed view showing the a section of finger 102 when it is urged against the front face 21 of printhead 20 and into the nozzle openings of channels 44 in the printhead 20, one representative channel 44 being shown in FIG. 2. FIG. 3 is a perspective view showing the printhead 20 and finger 102 substantially lengthwise, with the linear array of channels 44 (shown as nozzle openings) interacting with the finger 102. (In both Figures, the size of the channels 44 relative to the rest of the apparatus is significantly exaggerated.) A typical suitable pressure for the urging of finger 102 into the front face of printhead 20 is 500 grams per square centimeter. As can be seen in FIG. 3, this pressure against the front face of printhead 20 causes an outer portion 102*a* of the deformable finger 102 to bulge inward into the channel 44. There will thus be a degree of inward pressure on each ejector from the finger 102. This inward pressure externally supplied by the finger 102 is important in that (1) the inward pressure on the channels 44 creates a seal to prevent leakage of liquid ink from the channels 44 while the apparatus is in an idle mode; (2) the finger 102 minimizes or eliminates any available air space between a meniscus of liquid ink at the end of a channel 44 and the surface of the finger 102, which thus minimizes any evaporation of liquid ink of the channel 44, and also minimizes the effect of equalization of relative humidity on either side of such a meniscus, which is a primary cause of "viscous plugs" in idle ejectors; and (3) the fact that the finger 102 substantially contacts the printhead 20 around the edges of the nozzle of the channel 44 substantially minimizes the action of capillary forces which may cause the escape of liquid from the channels 44 during a long idle period.

Figure 4:
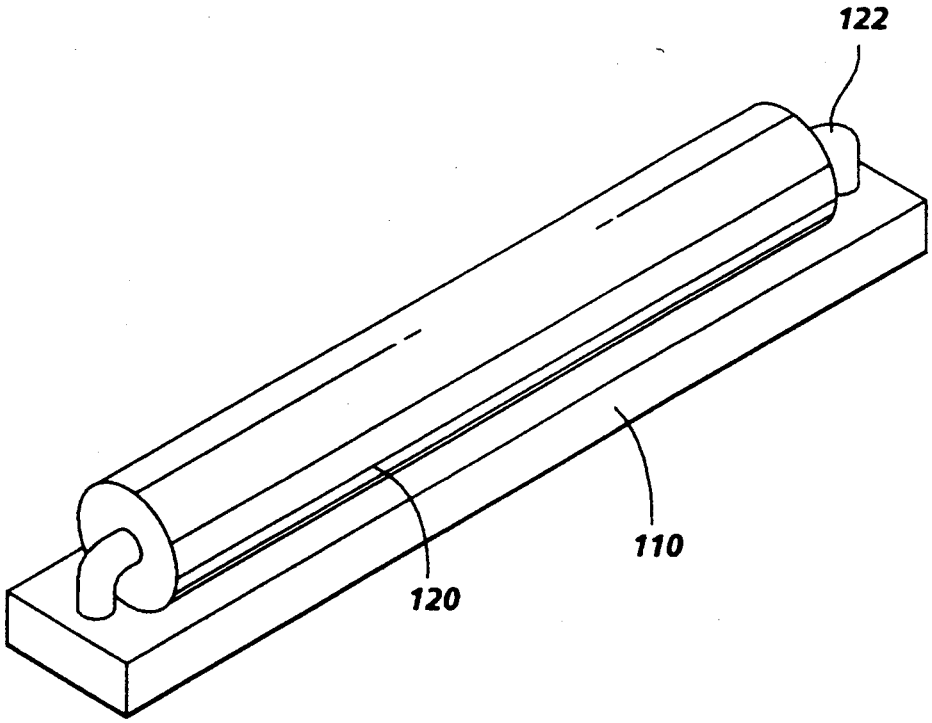
FIG. 4 and 5 are, respectively, perspective views of alternate embodiments of a finger according to the present invention.
Figure 5:
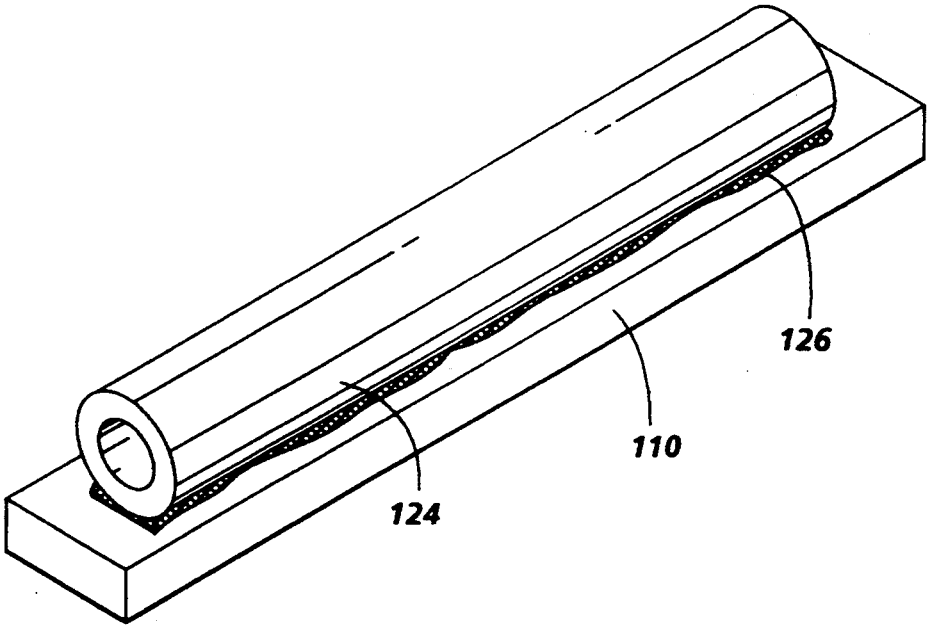

FIGS. 4 and 5 are, respectively, perspective views of alternate embodiments of deformable fingers according to the present invention. Each finger is shown on a platform 110, much in the manner of the above-described embodiment. In the embodiment of FIG. 4, the finger is in the form of a portion of clear silicone rubber tubing 120, which is mounted on a small portion of wire 122 passing therethrough. The outer surface of tubing 120 is, like the contact portion 106 of the above-described embodiment, preferably hydrophobic. The preferred outer diameter of tubing 120 is between 0.75 and 3.0 mm. The finger of FIG. 5 similarly includes a section of clear silicone rubber tubing, indicated as 124, which is simply mounted by means of a fillet 126 of silicone or any other type of hotmelt glue. Once again, the silicone tubing provides a hydrophobic outer surface and has a typical diameter of between 0.75 and 3.0 mm. The tubing in the embodiments of FIG. 4 or 5 may alternatively be made with modified or unmodified polyurethane, Viton® or any other suitable filled or untilled rubber or elastomeric material. The embodiments of FIGS. 4 and 5 may be preferable to the embodiment of FIGS. 1–3, in terms of simplicity of manufacture, mechanical stability and durability, or other practical considerations.

The deformable finger of the present invention has been demonstrated to provide superior performance over alternate capping means known in the art of ink-jet printing. For example, the "suction" cap which is used on many ink-jet printers currently being sold, and which is also substantially described in U.S. Pat. No. 4,567,494 referenced above, has the deliberate effect of creating a small amount of suction out of the channels, in direct contradiction to the present invention. Although the suction cap may be useful in removing viscous plugs or other contaminants from a channel, the advantage of the present invention is that the inward pressure against the channel tends to discourage the creation of such viscous plugs in the first place. Further, the rounded outer surface of the finger 102 is much less likely to cause leakage by capillary action from the channels 44. If, for example, a flat surface were merely urged against the front face of the printhead 20, the planar interface between the flat surface and the front face is very likely to create a capillary channel which will in fact draw out a quantity of liquid ink over a period of time.

In most types of thermal ink-jet ejector currently available, liquid ink is retained in the ejector channel prior to firing at a predetermined back-pressure holding the liquid ink in the channel. As the deformable finger of the present invention creates a net inward pressure at the end of the channel, this back-pressure is not interfered with in the capping process, as would be the case, for example, in capping arrangements in which suction is temporarily applied to the nozzle opening. Because the "zero-volume" seal of the present invention prevents the formation of viscous plugs of dried ink which traditionally have to be removed by suction, suction need never be applied to the channels. Because suction need never be applied to the channels, the risk of leakage of liquid ink from the channels into the system is significantly lessened. Finally, because the capping system of the present invention is manifestly simpler than most other prior-art arrangements, the present invention provides satisfactory performance at low cost.

Although the embodiments shown in the above description have been generally directed to reciprocating-carriage-type ink-jet printers, it is certainly conceivable to provide a relatively long finger, of the types described in any of the above embodiments, to be suitable for a full-width system, wherein a single linear array may be as long as nine inches or more to encompass an entire page width.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An apparatus for sealing an ink-jet printhead defining a nozzle opening in a surface thereof, comprising:

a deformable member having a narrow width contact portion sized and shaped to bulge into the nozzle opening said deformable member including the contact portion comprising flowable silicone adapted to contact the surface, and an inner portion comprising RTV silicone adapted to support the contact portion; and means for urging the deformable member into engagement with the surface at a predetermined pressure causing the contact portion of the deformable member to be deformed into the nozzle opening to seal the nozzle opening of the printhead.

2. An apparatus as in claim 1, wherein the deformable member comprises a hydrophobic surface.

3. An apparatus as in claim 1, wherein the deformable member comprises a silicone surface.

4. An apparatus as in claim 1, wherein the deformable member comprises a section of silicone rubber tubing mounted to a support portion for contacting the surface.

5. An apparatus as in claim 4, wherein the section of silicone rubber tubing is mounted to the support portion by means of a wire substantially disposed through the section of silicone rubber tubing.

6. An apparatus as in claim 1, wherein the urging means is adapted to urge the deformable finger into engagement with the surface at a pressure of about 500 grams per square centimeter.

7. An apparatus as in claim 6, wherein the deformable member deforms to form a contact width of less than 2 millimeters across the surface.

8. An apparatus as in claim 1, wherein the contact portion has a generally cylindrical shape and a diameter within a range of 1–2.5 min.

9. An apparatus as in claim 1, wherein the contact portion comprises clear silicone rubber tubing.

10. An ink-jet printer, comprising:

a printhead defining a linear array of nozzle openings in a surface; and a capping device, including a deformable member extending the length of the linear array, the deformable member having contact portions shaped and sized to bulge into each nozzle opening of the linear array of nozzle openings said deformable member including the contact portion comprising flowable silicone adapted to contact the surface, and an inner portion comprising RTV silicone adapted to support the contact portion; and means for urging the deformable member into engagement with the surface at a predetermined pressure causing the contact portions of the deformable member to be deformed into the nozzle openings to seal the nozzle openings of the printhead.

11. An ink-jet printer as in claim 10, wherein the deformable member comprises a hydrophobic surface.

12. An ink-jet printer as in claim 10, wherein the deformable member comprises a silicone surface.

13. An apparatus as in claim 10, wherein the deformable member comprises a section of silicone rubber tubing mounted to a support portion for contacting the surface.

14. An apparatus as in claim 13, wherein the section of silicone rubber tubing is mounted to the support portion by means of a wire substantially disposed through the section of silicone rubber tubing.

15. An ink-jet printer as in claim 10, wherein the urging means is adapted to urge the deformable finger into engagement with the surface at a pressure of about 500 grams per square centimeter.

16. An ink-jet printer as in claim 15, wherein the deformable member deforms to form a contact width of less than 2 millimeters across the linear array.

17. The apparatus as in claim 13, wherein the section of silicone rubber tubing is mounted to the support portion by means of a hot melt adhesive.

18. An ink-jet printer as in claim 16, wherein each nozzle opening is about 50 micrometers wide, and the deformable member deforms to form a contact width of about 0.5 mm across the linear array of nozzle openings.

* * * * *